US007195245B1

(12) United States Patent
Pan et al.

(10) Patent No.: US 7,195,245 B1
(45) Date of Patent: Mar. 27, 2007

(54) PRINT-TYPE MAGNETIC DARTBOARD

(75) Inventors: Francis Chung Hwa Pan, Taichung County (TW); Wei-Lung Tai, Taichung County (TW)

(73) Assignee: Forhouse Corporation, Taichung Hsien (TW)

( * ) Notice: Subject to any disclaimer, the term of this patent is extended or adjusted under 35 U.S.C. 154(b) by 0 days.

(21) Appl. No.: 11/229,656

(22) Filed: Sep. 20, 2005

(51) Int. Cl.
*F41J 5/04* (2006.01)

(52) U.S. Cl. ..... 273/371

(58) Field of Classification Search ..... 273/371–377
See application file for complete search history.

(56) References Cited

U.S. PATENT DOCUMENTS 6,155,570 A * 12/2000 Allison et al. ..... 273/373

FOREIGN PATENT DOCUMENTS

GB 2086243 A * 5/1982
GB 2342053 A * 4/2000

* cited by examiner

*Primary Examiner*—Mark S. Graham
(74) *Attorney, Agent, or Firm*—Birch, Stewart, Kolasch & Birch, LLP

(57) ABSTRACT

A dartboard has board member, and the board member has a plurality of target blocks to be stuck by darts. The back side of the board member has an induction layer and a magnetic member. The magnetic member provides a fixed magnetic field, and the induction layer has a substrate and a circuit on the substrate. A dart with a steel iron or iron alloy point sticks into the board member, and disturbs the distribution of the magnetic field provided by the magnetic member, causing electromagnetic induction and inducing a current in the circuit of the induction layer to provide an automatic score.

6 Claims, 2 Drawing Sheets

PRINT-TYPE MAGNETIC DARTBOARD

BACKGROUND OF THE INVENTION

1. Field of the Invention

The present invention relates generally to a darts game device, and more particularly to a print-type magnetic dartboard.

2. Description of the Related Art

As shown in FIG. 1 and FIG. 2, a conventional dartboard consists of plural target blocks 1 respectively surrounded by a coil 2. When a dart (not shown) with a magnetic point sticks into the target block 1, the magnetic point of the dart provides the coil 2 with a varying magnetic field and causes electromagnetic induction, such that the coil 2 has a current. A processor (not shown) receives the current from coil 2 to automatically determine the score. This kind of dartboard has no fatal drawback, but the dart must have a magnetic point. Conventional methods for manufacturing darts with a magnetic point are to embed a magnet in the point, or magnetizing the point. These darts are expensive and difficult to manufacture.

The coils are usually mounted on the target blocks 1 one by one, which is a difficult job. The target blocks 1 are provided with metallic shields 3 to cover the coils 2. The shields 3 protect the coils 2 from being damaged by the dart, and also separate target blocks 1. When the dart hits the metallic shield 3, the dart will not stick into the target block 1.

SUMMARY OF THE INVENTION

The primary objective of the present invention is to provide a dartboard which prevent the induction circuit from being damaged when the darts sticks into the target blocks.

According to the objective of the present invention, a dartboard has a board member consisting of a plurality of target blocks which can be stuck by darts. An induction layer and a magnetic member are provided on the back side of the board member. The magnetic member provides a fixed magnetic field, and the induction layer has a substrate and a circuit on the substrate. A dart with a steel, iron or iron ally point sticks into the board member and disturbs the distribution of the magnetic field provided by the magnetic member, thereby causing electromagnetic induction and inducing a current in the circuit of the induction layer for an automatic score.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
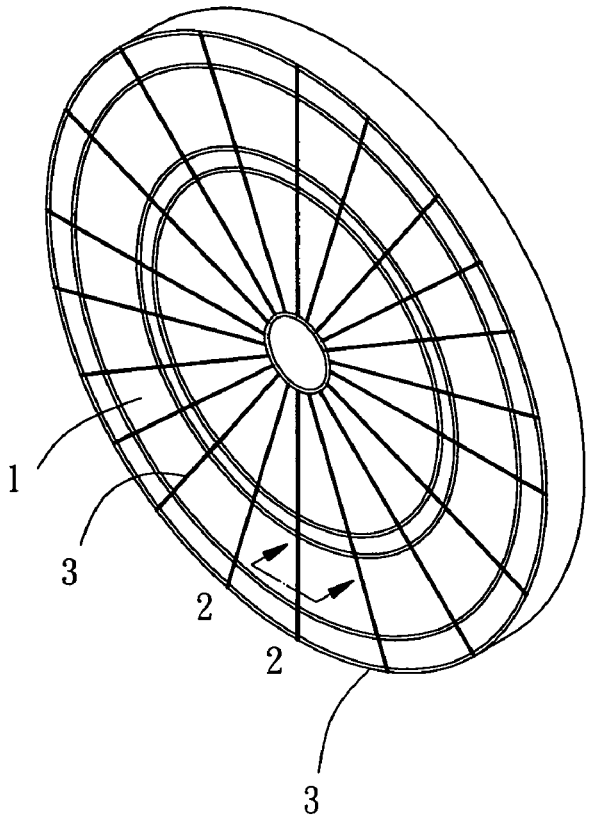
FIG. 1 is a perspective view of the conventional dartboard.
Figure 2:
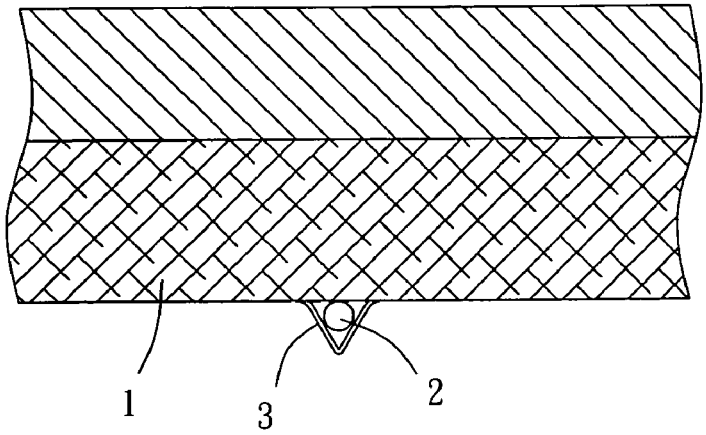
FIG. 2 is a sectional view along the 2—2 line of FIG. 1.

As shown in FIG. 2, a dartboard of the first preferred embodiment of the present invention comprises:

A disk-like board member 10 is made of sisal or sponge which allows targets to stick thereon. The board member 10 consists of plural target blocks.

A magnetic member 20 is provided on a back side of the board member 10. The magnetic member is a magnet or plural magnets mounted on the board member 10, in order to provide a fixed magnetic field. Each of the target blocks may have a magnet on the back side. Alternatively, a magnet may only be attached on the back side of the board member 10.

Figure 3:
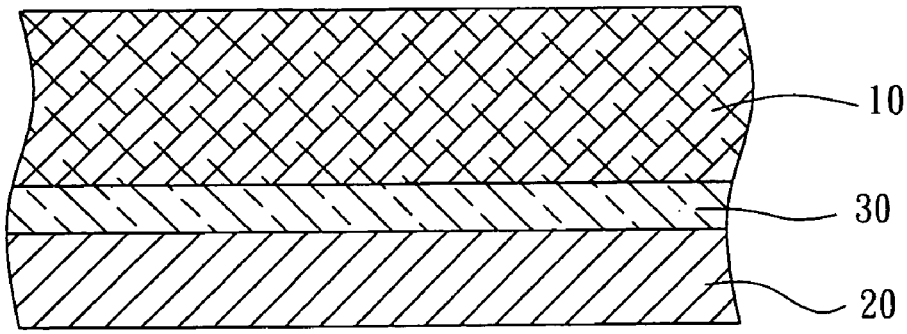
FIG. 3 is a sectional view of a first preferred embodiment of the present invention.
Figure 4:
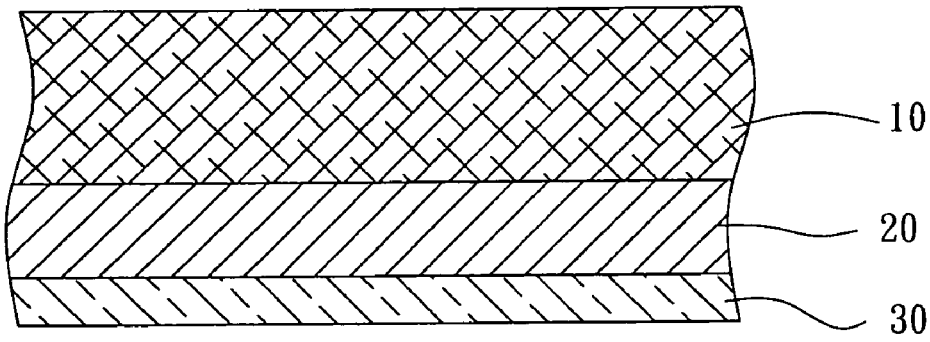
FIG. 4 is a sectional view of a second preferred embodiment of the present invention.

An induction layer 30 is between the board member 10 and the magnetic member 20 (referring to FIG. 3) or on a back of the magnetic member 20 (referring to FIG. 4). The induction layer 30 has a substrate with a circuit thereon. The circuit is made of gold, silver, copper, carbon or conductive ink printed on the substrate with a predetermined pattern.

While a dart (not shown) with a point made of steel, iron or an ally sticks into the target block of the board member 10, the point is instantaneously magnetized by the fixed magnetic field provided from the magnetic member 20 and changes the distribution of the fixed magnetic field. This varying of the magnetic field causes electromagnetic induction and induces a current in the circuit of the induction layer 30. A processor (not shown) receives the current and, based on the current, identifies which target block has been hit by the dart, to provide an automatic score.

The darts for the dartboard of the present invention are not required to have magnetic points. Instead, it is only necessary for the points of the darts to be induced by the magnetic field. Accordingly, conventional darts with steel, iron or alloy points can be applied to the dartboard of the present invention. Accordingly, the present invention removes limitations on the type of dart required for the electronic dartboard, so as to be more convenient to the consumers. In addition, the induction layers 30 are suitable for mass production. Accordingly, manufacture of the dartboard of the present invention is easier and faster, as the induction layers 30 can be attached on the board member 10 or on the magnetic member 20 by automatic production. Furthermore, there is no metallic shield on the front side of the board member 10. Darts will therefore stick into the board member 10 without any interference. The darts only stick into the board member 10 and will not reach the induction layer 30, so that the induction layer 30 will not be damaged. This increases the stability of the dartboard of the present invention.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A dartboard, comprising:

a board member having a plurality of target blocks to be stuck by darts;

an induction layer on a back side of the board member, which has a substrate and a circuit on the substrate, and a magnetic member on a back side of the induction layer to provide a fixed magnetic field.

2. The dartboard as defined in claim 1, wherein the magnetic member has a magnet fixed on the induction layer.

3. The dartboard as defined in claim 1, wherein the magnetic member has plural magnets fixed on the induction layer.

4. A dartboard, comprising:

a board member having a plurality of target blocks to be stuck by darts;

a magnetic member on a back side of the board member to provide a fixed magnetic field, and an induction layer on a back side of the magnetic member, which has a substrate and a circuit on the substrate.

5. The dartboard as defined in claim 4, wherein the magnetic member has a magnet fixed on the induction layer.

6. The dartboard as defined in claim 4, wherein the magnetic member has plural magnets fixed on the induction layer.

* * * * *